United States Patent [19]

Neithercutt

[11] 3,934,303

[45] Jan. 27, 1976

[54] EXPLOSIVE TORCH TIP CLEANER TOOL

[76] Inventor: Marvin C. Neithercutt, 2600 Frontier Drive, Midland, Tex. 79701

[22] Filed: Aug. 29, 1974

[21] Appl. No.: 501,640

[52] U.S. Cl. ..... 15/406

[51] Int. Cl.[2] ..... A47L 5/00; F23J 1/00

[58] Field of Search ..... 15/406, 405, 408, 314, 15/409

[56] References Cited

UNITED STATES PATENTS

| | | | |
|---|---|---|---|
| 1,388,854 | 8/1921 | Dezendorf | 15/406 |
| 2,102,320 | 12/1937 | Kandarian | 15/406 |
| 2,494,298 | 1/1950 | Jones | 15/406 |
| 3,131,418 | 5/1964 | Morningstar | 15/406 |
| 3,851,352 | 12/1974 | Hibberd | 15/405 |

*Primary Examiner*—Harvey C. Hornsby
*Assistant Examiner*—Donald B. Massenberg
*Attorney, Agent, or Firm*—Marcus L. Bates

[57] ABSTRACT

A tool for holding a torch tip and a blank cartridge respective to one another so that the blank cartridge can be detonated and the high-velocity gases issuing therefrom used to clean out the flow passageways of the torch tip.

4 Claims, 6 Drawing Figures

EXPLOSIVE TORCH TIP CLEANER TOOL

BACKGROUND OF THE INVENTION

Oxy-acetylene cutting torch tips occasionally become clogged with foreign matter, such as carbonaceous material resulting from backfiring of the gases through the tip, or nozzle, or ingestion of oxidized metal which lodges within one of the small outlet passageways of the tip, thereby plugging the tip and causing the cutting torch to operate in an erratic and unsatisfactory manner.

Special reams or drills of various sizes are available for probing into and cleaning torch tips. These reams are generally suitable for removing soft material before it has been coked into a solidified mass. However an undue amount of time is required to insert each of the cleaner reamers into each of the radially spaced torch tip outlet passageways. Often an improper size reamer is selected and ultimately the outlet passageways are unduly enlarged thereby causing excessive flow of combustibles therethrough. Sometimes the cleaner reamer becomes stuck and broken within a passageway, causing the torch tip to be discarded.

It is therefore desirable to be able to remove a torch tip from the end of an oxy-acetylene cutting torch apparatus and remove debris from the flow passageways thereof by merely placing the tip along with a blank cartridge within a special tool, striking the tool against some hard surface, whereupon the resulting explosive force of the gases from the cartridge removes debris from the passageways of the tip, thereby rapidly restoring the tip to a satisfactory working condition in a new and improved manner.

SUMMARY OF THE INVENTION

This invention broadly comprehends a tool for holding a torch tip and a blank cartridge respective to one another so that the tool can be manipulated to detonate the blank cartridge causing the high pressure gases therefrom to be directed through the passageways of the tip thereby cleaning debris therefrom and restoring the tip to a more serviceable condition.

More specifically, the present invention comprehends a torch tip cleaning apparatus comprising a body member small enough in size to be hand held, and having an axial bore formed therethrough with a marginal length of the axial bore being sized to removably receive a blank cartridge concentrically arranged and tightly seated therein.

A breech member is removably affixed to the cartridge containing end of the central body member for detonating the cartridge contained therein. A spring loaded firing pin, slidably received in axial alignment respective to the detonator of the cartridge, is positioned within the breech member and biased away from the cartridge so that the cartridge cannot be accidentally detonated. The firing pin includes an elongated shaft portion which extends away from the breech member so that it can be used to remove a spent cartridge from its seat.

A torch tip holder has an axial bore formed therethrough, with the free end portion thereof being made into a muzzle, and with the opposed end portion thereof being removably affixed to the central body portion. A marginal length of the bore is sized to receive a torch tip sealingly seated therein with the torch tip having the passageways thereof aligned with respect to the axial bore.

The tool of the present invention enables a torch tip to be placed into the holder, a blank cartridge placed into the central body member, the firing pin struck in any suitable manner causing the primer of the cartridge to detonate; whereby, the explosive gases resulting from the detonation of the cartridge are directed through the passageways of the tip, thereby enhancing removal of any obstruction therefrom.

Accordingly, a primary object of the present invention is the provision of a tool which enables a torch tip to be cleaned by utilizing the explosive forces provided by a blank cartridge.

Another object of the invention is to provide an improved means to efficiently clean a torch tip of an oxy-acetylene cutting torch apparatus.

A further object of this invention is to provide a tool which enables a torch tip to be cleaned rapidly, efficiently, and inexpensively.

A still further object of this invention is to provide a tool for opening clogged passageways of a torch tip.

Another and still further object is to provide means for producing a tremendous pressure drop across a torch tip thereby removing debris contained within the passageways thereof.

These and various other objects and advantages of the invention will become readily apparent to those skilled in the art upon reading the following detailed description and claims and by referring to the accompanying drawings.

The above objects are attained in accordance with the present invention by the provision of apparatus fabricated in a manner substantially as described in the above abstract and summary.

DETAILED DESCRIPTION OF THE PREFERRED EMBODIMENT

Figure 1:
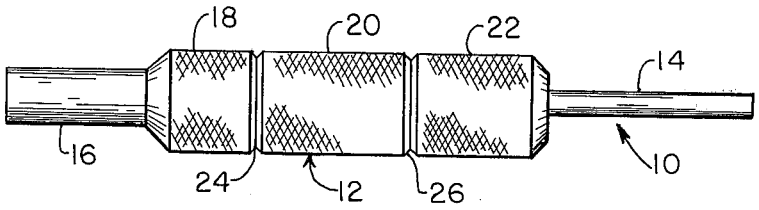
FIG. 1 is a side elevational view of an assembled torch tip cleaning tool made in accordance with the present invention.

In FIG. 1 the numeral 10 indicates a tool made in accordance with the present invention. The tool comprises an elongated tubular body 12 which holds a torch tip and a blank cartridge relative to one another in a particular manner so that the cartridge can be detonated, causing high pressure gases issuing therefrom to be directed into and clean out the flow passageways of the torch tip. Detonation is achieved by actuation of a shaft 14, while the explosive gases flow from the muzzle or outlet at 16. The apparatus 12 comprises a first, second, and third member 18-22, also referred to as a torch tip holding member 18, a central member 20 which holds a blank cartridge therein, and a breech member 22 which has mechanism therein for detonating the blank cartridge contained within the central member. Each member is threadedly secured to one another in a removable manner so that one can readily be detached from the other.

Figure 2:
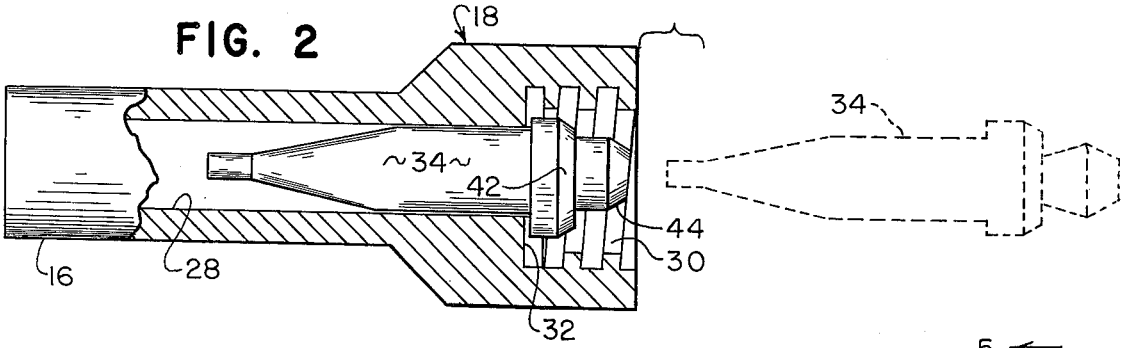
FIG. 2 is an enlarged detail showing part of the tool seen in FIG. 1, with parts thereof being removed and the remaining parts thereof being shown in cross-section.

Looking now to the details of FIG. 2, wherein there is disclosed the before mentioned torch tip holder having an axial bore 28 longitudinally disposed therethrough, with the free end portion thereof being made into the before mentioned muzzle, and with the opposed end portion being threaded at 30 in a particular manner so that it can be removably affixed to only one of the two end portions of the central member.

A marginal length of the axial bore is sized at 32 for removably receiving the illustrated torch tip or torch nozzle 34 therein. Those skilled in the art will appreciate that the nozzle contains passageways which are placed into alignment with the axial bore of the tool.

Figure 3:
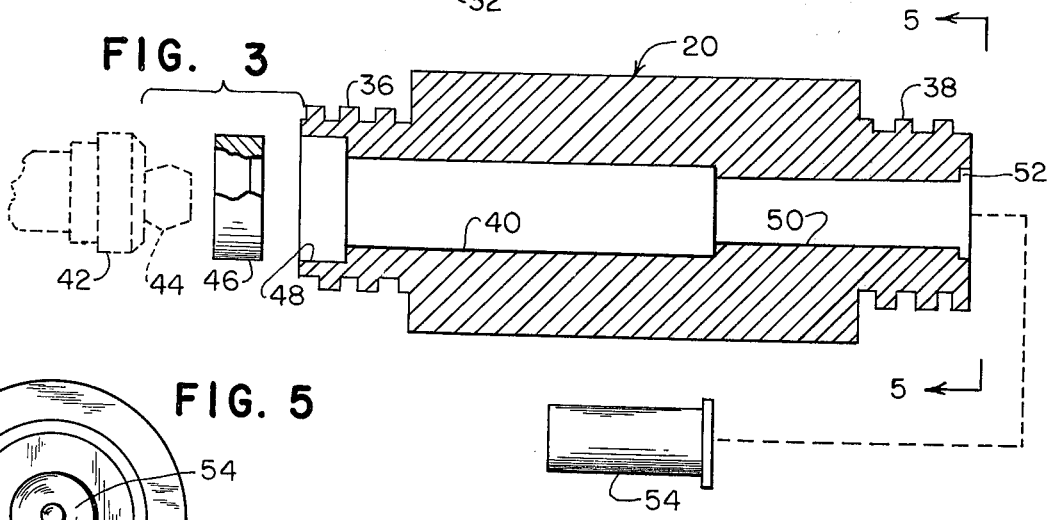
FIG. 3 is an enlarged, exploded detail of another part of the apparatus disclosed in FIG. 1, with parts thereof being removed and other parts thereof being shown in cross-section.
Figure 5:
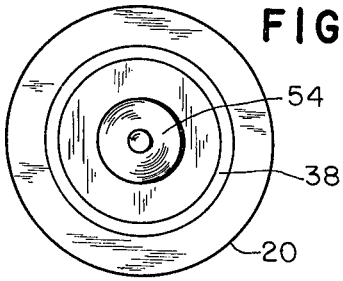
FIG. 5 is an end view of FIG. 3, looking in the direction indicated by the arrows at numeral 5; and, FIG. 6 is a cross-sectional view taken along crooked line 6—6 of FIG. 4.

In FIG. 3, there is disclosed the details of the central member 20. Opposed end portions 36 and 38 of the central member is threaded along a marginal longitudinal length thereof, and a central bore 40 is formed in axially alignment with the axial bore 28 of the tip holder.

A conical sealing shoulder 42 of the torch tip is received within an adapter 46 so that the radial passageways located between shoulder 42 and member 44 of the tip are exposed to the high velocity gases flowing from the detonated cartridge. Adapter 46 is removably received within a seat 48 formed within a marginal end portion of the axial bore so that various sizes adapters can be readily substituted one for the other. This expedient provides unlimited accommodation for any number of different designed nozzles.

The axial bore is sized at 50 and 52 so that a center fire blank cartridge 54 can be placed therein in a removable manner with the cartridge being concentrically aligned with the axial bore, nozzle adapter, and muzzle.

Figure 4:
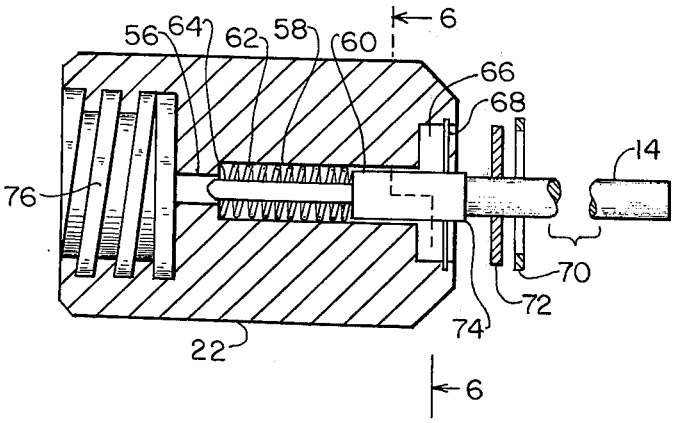
FIG. 4 is an enlarged, cross-sectional, exploded, detailed view of another part of the apparatus disclosed in FIG. 1.
Figure 6:
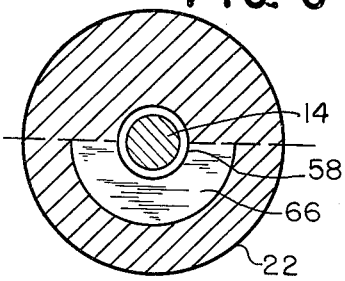

The breech member has a reduced diameter axial bore 56 which enlarges in diameter at 58 for reciprocatingly receiving enlargement 60 of the illustrated firing pin therewithin. A coiled spring 62 is compressed between shoulder 64 and the enlargement in the illustrated manner of FIG. 4.

Counterbore 66 outwardly opens and is provided with a circumferentially extending groove 68 which receives snap ring 70 seated therein, with washer 72 being sandwiched between the back wall of the counterbore and the snap ring so that a face of the washer abuttingly engages a face 74 of the enlargement, thereby capturing the firing pin in a slidable and reciprocating manner respective to the breech member and to the cartridge seated within the central member.

Threaded female counterbore 76 receives threaded male member 38 therein, while the threaded female counterbore 30 receives the threaded male member 36 therein. The wide acme threads enhance rapid teardown and obviates inadvertent sticking of one member to another.

In operation, member 18 is grapsed in the left hand, member 20 in the right and the two unscrewed from one another so that a torch tip 34 can be inserted into member 18 in the illustrated manner of FIG. 2. The threads 30 and 36 are made up, and then members 20 and 22 are separated from one another. A live blank cartridge 54 is placed within seat 50, and threads 30 and 38 made up. The assembled apparatus containing the plugged nozzle and blank cartridge is held in the right hand, the muzzle 16 is directed into an unobstructed portion of the atmosphere, and the tool struck against a hard surface such as a pipe vice, with the shaft 14 arresting motion, thereby causing the detonator of the cartridge to explode the charge contained therein, whereupon high velocity gases flow through the axial bore 40, through the passageways of the nozzle 34, and into the axial bore 28 where the gases emerge from the muzzle, carrying therewith the debris which caused the nozzle to plug.

I claim:

1. In a hand-held torch tip cleaning apparatus for effecting a high pressure differential across the flow passageway of a torch tip removably contained within the apparatus and from which debris causing obstruction thereof is to be ejected, the combination comprising:

a central body member having a central bore formed therethrough with a marginal length of said central bore being sized to removably receive a blank cartridge concentrically arranged in axially aligned relationship therein and seated at one marginal end therein;

a breech member removably affixed to the cartridge containing end of said central body member, said breech member having an axial bore which is axially aligned with said central bore, a spring loaded firing pin assembly slidably received in axial alignment with respect to said axial bore and with the detonator of the cartridge, such that the firing pin assembly is yieldably biased away from the cartridge; said firing pin assembly having an elongated shaft axially aligned with said central and axial bore and extending away from and clear of said breech member a distance at least equal to the longitudinal axial length of the central bore formed through said central member; so that the breech member can be removed from the central member and said shaft can then be used to forcibly remove a spent cartridge from seated relationship within said central member;

a torch tip holding member having an axial bore formed therethrough with a free depending end portion thereof being made into the form of a muzzle, the opposed end portion of said holding member being removably affixed in axially aligned relationship to said central body member, a marginal length of the last said axial bore being sized to removably receive a torch tip therein such that the flow passageways of the torch tip are axially aligned with said axial bore; the outer periphery of the torch tip being sealingly engaged with the inner periphery of the last said axial bore so that when a torch tip is placed into the torch tip holder and a blank cartridge is placed into the central body member, the firing pin assembly can be struck, thereby causing the primer engaging end thereof to move into contact with and detonate the explosive charge thereof, thereby causing the explosive gases to develop a high pressure differential across the torch tip, and the explosive gases to flow through the passageways of the torch tip to thereby enhance removal of any obstruction therefrom.

2. The torch tip cleaner of claim 1 wherein said torch tip receiving portion of said central bore is provided with a removable insert to enable the diameter and length of the torch tip receiving portion of the central bore to be changed to thereby accommodate two different types of torch tips; and, means by which the assembled relationship of said holding member, central member, and breech member are connected together in a manner whereby they are always properly arranged in operative relationship respective to one another.

3. A hand-held tool for holding a blank cartridge and a plugged torch tip so that the blank cartridge can be detonated and the explosive gases of the resulting reaction directed through a plugged passageway of the torch tip to thereby unplug the passageway, said tool comprising first, second, and third members having means by which they are connected to one another in series relationship to thereby provide an elongated body which is separable into its recited first, second, and third components;

means forming a firing pin assembly, said firing pin assembly having an elongated shaft thereon; a longitudinally extending axial bore formed through said elongated body; said first member forming one end of said bore, said third member forming an opposed end of said bore, said third member being closed by said firing pin assembly being slidably received in a reciprocating manner within a marginal, reduced end of said bore;

an outlet formed in said first member in opposed relationship to said firing pin assembly, through which gases may be expelled to the atmosphere;

said bore in said first and second members being sized to receive a torch tip securely seated therein so that any explosive gases flowing through said axial passageway are forced to travel through any passageway found in said torch tip;

said bore in said second member being sized to receive a blank cartridge seated in axially aligned relationship therein, with the detonator thereof being aligned such as to be detonated by said firing pin assembly;

said first, second, third members, said cartridge, said firing pin assembly, and said torch tip being concentrically arranged with respect to one another;

said elongated shaft having a marginal portion which extends away from said third member a distance equal to the length of the axial bore formed through said second member, so that said third member can be removed from said second member and said shaft can then be used to forcibly remove a spent cartridge from seated relationship respective to said second member.

4. The tool of claim 3 wherein said torch tip receiving portion of said axial bore is provided with an insert means which enables the diameter and length of the tip receiving portion of said axial bore to be changed to accommodate alternate sizes of torch tips; and, means by which said first, second, and third members are connected together in series axially aligned relationship whereby the assembled relationship of said first, second, and third members are always properly disposed respective to each other.

* * * * *